US009745023B2

(12) United States Patent
Beatty

(10) Patent No.: US 9,745,023 B2
(45) Date of Patent: Aug. 29, 2017

(54) WATER ANCHORS

(71) Applicant: DIVEMEX LIMITED, Fforestfach (GB)

(72) Inventor: David Beatty, Kenfig Hill (GB)

(73) Assignee: TIDAL ANCHORS HOLDINGS LIMITED, Swansea (GB)

( * ) Notice: Subject to any disclaimer, the term of this patent is extended or adjusted under 35 U.S.C. 154(b) by 31 days.

(21) Appl. No.: 14/782,683

(22) PCT Filed: Apr. 10, 2014

(86) PCT No.: PCT/GB2014/051117

§ 371 (c)(1),
(2) Date: Oct. 6, 2015

(87) PCT Pub. No.: WO2014/167334

PCT Pub. Date: Oct. 16, 2014

(65) Prior Publication Data

US 2016/0059935 A1 Mar. 3, 2016

(30) Foreign Application Priority Data

Apr. 10, 2013 (GB) ..... 1306525.5

(51) Int. Cl.
*B63B 21/34* (2006.01)
*B63B 21/46* (2006.01)

(52) U.S. Cl.
CPC ..... *B63B 21/34* (2013.01); *B63B 21/46* (2013.01)

(58) Field of Classification Search
CPC ..... B63B 21/24; B63B 21/243; B63B 21/26; B63B 21/262; B63B 21/265; B63B 21/29;
(Continued)

(56) References Cited

U.S. PATENT DOCUMENTS 5,899,165 A * 5/1999 Komura ..... B63B 21/22 114/294
5,975,001 A * 11/1999 Verrier ..... B63B 21/46 114/301

(Continued)

FOREIGN PATENT DOCUMENTS

BR WO 0050301 A1 * 8/2000 ..... B63B 21/26
EP 0 930 224 A1 7/1999

(Continued)

OTHER PUBLICATIONS

International Search Report under date of mailing of Sep. 12, 2014 in connection with PCT/GB2014/051117.

*Primary Examiner* — Ajay Vasudeva
(74) *Attorney, Agent, or Firm* — Quarles & Brady LLP

(57) ABSTRACT

Anchor apparatus (1) including an anchor (2) and a slideable anchor bridle (3), the anchor having a lower part or body portion with oppositely disposed anchoring formations (6*a*, 6*b*) extending therefrom and an upper part including bridle attachment means in the form of at least two parallel bridle rails extending above and between the oppositely disposed anchoring formations (7,8), limbs (4,5) of the anchor bridle being slideably attached, in use, to respective bridle rails (7,8), the arrangement being such that when deployed, the anchor can be pulled in one direction whereby to permit one of the oppositely disposed anchoring formations to penetrate the sea bed and whereafter if and when the anchor is pulled in the opposite direction after the bridle limbs have slid along the bridle rails, the other of the oppositely disposed anchoring formations also penetrates the seabed, whereafter the anchor can continue to be pulled in successively alternate directions via the bridle to penetrate progressively further into the sea bed until firmly fixed therein.

12 Claims, 4 Drawing Sheets

Figure 1:
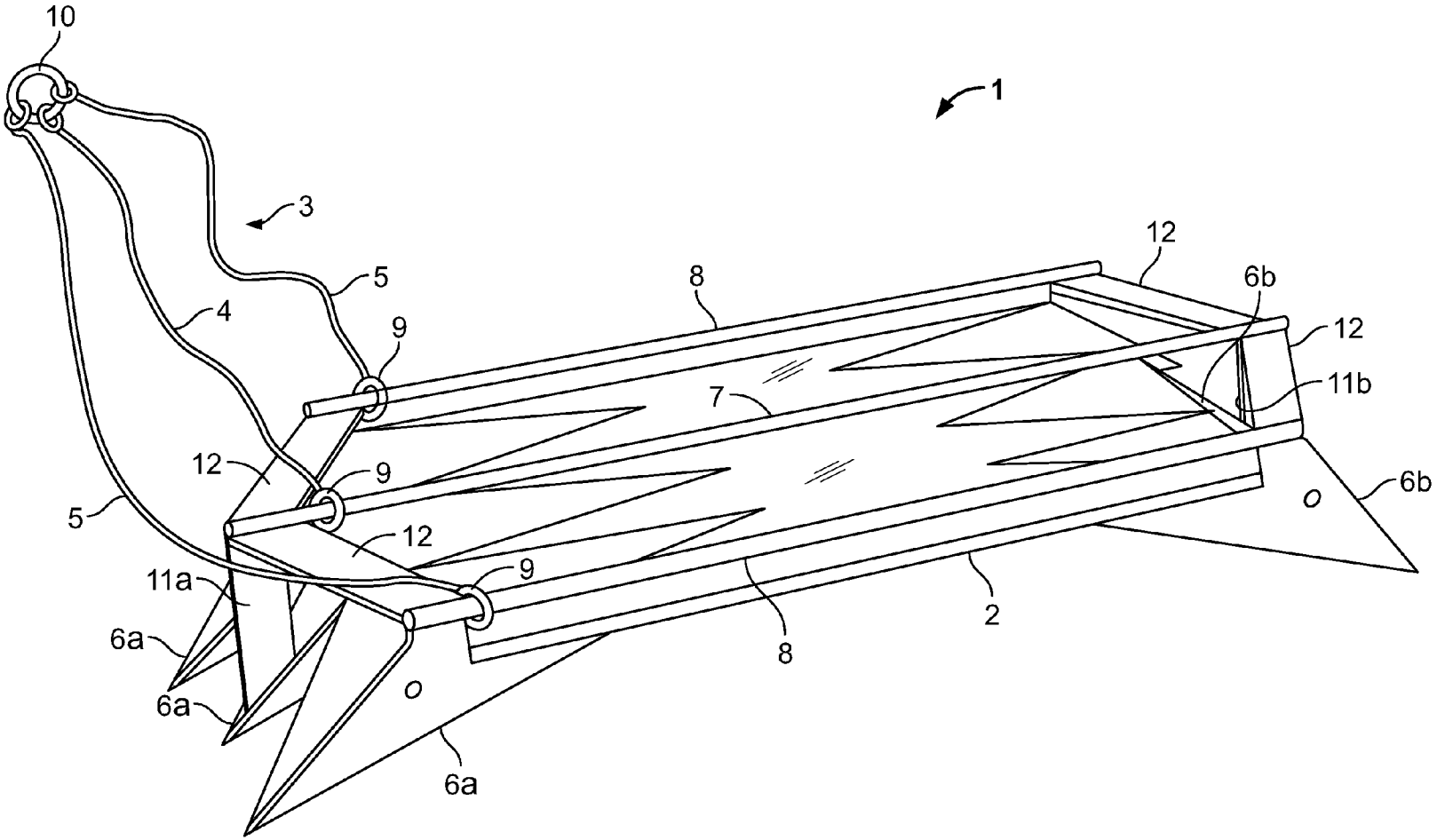

(58) Field of Classification Search
CPC ..... B63B 21/30; B63B 21/32; B63B 21/34; B63B 21/36; B63B 21/38; B63B 21/40; B63B 21/42; B63B 21/44; B63B 21/46
USPC ..... D12/215
See application file for complete search history.

(56) References Cited

U.S. PATENT DOCUMENTS

| | | | | |
|---|---|---|---|---|
| 6,098,565 | A | 8/2000 | O'Neil | |
| 7,121,223 | B1 | 10/2006 | Whitener | |
| D688,191 | S * | 8/2013 | Fowler | D12/215 |
| 9,233,737 | B2 * | 1/2016 | Bruce | B63B 21/38 |
| 9,233,738 | B2 * | 1/2016 | Bruce | B63B 21/42 |
| 2008/0314305 | A1 * | 12/2008 | Bryant | B63B 21/40 114/304 |

FOREIGN PATENT DOCUMENTS

| | | | |
|---|---|---|---|
| GB | 2 227 988 | A | 8/1990 |
| WO | 98/08734 | A1 | 3/1998 |

* cited by examiner

WATER ANCHORS

CROSS-REFERENCE TO RELATED APPLICATIONS

This application represents the national stage entry of PCT International Application No. PCT/GB2014/051117 filed Apr. 10, 2014, which claims the benefit of Great Britain Patent Application No. 1306525.5, filed on Apr. 10, 2013, the disclosures of which are hereby incorporated by reference in their entirety for all purposes.

This invention relates to anchors for permanently or temporarily mooring floating objects such as boats and buoys in water, such as in tidal estuaries, although the invention is not limited to such uses.

A conventional anchor for ships and other large vessels or floating equipment comprises one or more flukes pivotally mounted on one end of an elongated shank which has on its other end an eye by which it can be attached to the end of e.g. an anchor cable, the cable itself being connected at its other end to a winch on board the moored vessel or anchor handling tug. When the anchor is dropped onto the sea or river bed it is dragged along at a very shallow angle by a correspondingly long length of cable or chain, which may typically be around three times the depth of water, to permit the or each anchor fluke to dig into the sea bed and thereby serve to anchor the vessel in place at a point remote from the anchor itself. Such an arrangement is generally satisfactory for anchoring in still water or in water flowing in one direction only, but it will be apparent that where, e.g. tidal flow reverses (or, in the case of a large ship, where the wind direction changes), the anchor may have to be re-set if it is not provided with additional flukes that work in the opposite direction. Where such a multiple-fluke arrangement is adopted, only one set of flukes at any given time contributes to the anchor's purchase on the sea bed, an inefficient configuration which adds considerably to the cost of the anchor. In addition, the distance between the vessel and the anchor when moored in such a fashion can become problematic in requiring a correspondingly large radial area for the vessel to move in. The minimum length of anchor cable required, which in turn determines the radius of possible movement (the swinging circle) of the moored vessel, is constrained by the requirement to maintain a comparatively shallow angle at its point of attachment to the anchor, where an angle of around 26 degrees or greater will typically result in a conventional anchor being pulled free of its mooring ground. This problem is exacerbated at sites subject to large tidal ranges, where additional anchor line length must be provided to accommodate rise and fall of the floating vessel or object.

A conventional anchor of the aforesaid type is also impractical for use where taut-line moorings are required, such as for navigation buoys, where it is necessary for them to have a small swinging circle for maintaining accurate positioning. In such circumstances it is common to use permanent or semi-permanent installations, such as large and correspondingly heavy concrete blocks which often prove difficult or impossible to retrieve when they become unserviceable or are no longer required and are consequently left in place, thereby potentially causing a shipping hazard. This is especially problematic, since such blocks will often have been sited immediately adjacent to defined navigation channels or vessel manoeuvering areas.

A further important performance criterion is the distance over which the anchor must be drawn, under given bed conditions, before gaining a secure purchase on the bed. This in turn governs the accuracy of positioning which can be achieved for the moored vessel or equipment. It is moreover an important consideration in cases where available manoeuvering space is constrained by e.g. the presence of sensitive sea bed installations (e.g. pipelines and cables) in the vicinity.

The present invention is derived from the realisation that there is a need to resolve the aforementioned problems and in particular to provide effective means for anchoring vessels or other floating equipment in water, especially tidal water, that is cost-effective and has fewer redundancies than through the use of multi-fluke anchors or by the use of permanent installations.

According to a first aspect of the invention there is provided anchor apparatus including an anchor and a slideable anchor bridle, the anchor having a lower part or body with oppositely disposed anchoring formations extending therefrom and an upper part including bridle attachment means in the form of at least two parallel bridle rails extending above and between the oppositely disposed anchoring formations, limbs of the anchor bridle being slideably attached, in use, to respective bridle rails, the arrangement being such that when deployed, the anchor can be pulled in one direction whereby to permit one of the oppositely disposed anchoring formations to penetrate the sea bed and whereafter if and when the anchor is pulled in the opposite direction after the bridle limbs have slid along the bridle rails, the other of the oppositely disposed anchoring formations also penetrates the seabed, whereafter the anchor can continue to be pulled in successively alternate directions via the bridle to penetrate progressively further into the sea bed until firmly fixed therein.

With this arrangement, it has been found that the anchor can be placed accurately where required and will remain thereafter embedded on the sea floor using a relatively steep line or chain angle as compared to the use of conventional fluke anchors which, in turn, means that it has a much smaller swinging circle, making it also suitable for use for permanent anchoring of e.g. marker buoys.

Preferably, the oppositely disposed anchoring formations are fluted claws or spikes which may protrude beyond the anchor from either end thereof.

Advantageously, the anchor includes three parallel bridle rails, the central bridle rail being slightly longer than the other rails such that, in the event of the anchor being pulled by the side limbs of the bridle tipping forward the central limb of the bridle comes momentarily into tension, allowing the outer bridle limbs to slacken and, because of its forward, protruded, position at the end of the central bridle rail so imparts to the anchor a restoring moment countering any forward tipping effect until the anchor resumes its proper attitude and its drag load is once more transferred to the outer bridle limbs.

In a preferred embodiment of the invention, the central bridle rail is mounted at its forward end only on an upstanding stop plate and the trailing end of the central bridle rail is mounted only on a corresponding stop plate, between each of which is disposed a slideably mounted elongated anchor shank in the manner of a draw-bolt, with the shank having multiple sleeved connection points to the central bridle rail and having at its forward end means for connection to a respective bridle, with the two outside bridle rails being secured to but spaced from respectively opposite sides of the anchoring formations. Such a configuration means that the forward and trailing end of the anchor and hence the anchoring means at each end present an open configuration such that as the anchor is being set into the sea bed the possibility of it becoming snagged with e.g. boulders on the sea bed is minimised, with the boulders being able to roll or slide over and away from the anchor while the anchoring formations become embedded within the sea bed.

According to a second aspect of the invention there is provided an anchor adapted for use with a slideable anchor bridle, the anchor comprising or including a body portion with oppositely disposed anchoring formations extending therefrom and bridle attachment means in the form of at least two parallel bridle rails extending above and between the oppositely disposed anchoring formations, the bridle rails being connectable to respective limbs of an anchor bridle such that, in the use, when the anchor is deployed it can be pulled in one direction whereby to permit one of the oppositely disposed anchoring formations to penetrate the sea bed and whereafter if and when the anchor is pulled in the opposite direction after the bridle limbs have slid along the bridle rails, the other of the oppositely disposed anchoring formations also penetrates the sea bed, whereafter the anchor can continue to be pulled in successively alternate directions via the bridle to penetrate progressively further into the sea bed until firmly fixed therein.

Preferably, the anchor includes a central bridle rail and two oppositely disposed side rails.

Conveniently, the side rails have curved ends that are fixed to oppositely disposed anchor formations.

Advantageously, the anchor formations in the form of fluted claws or spikes which act to scoop into the sea bed as the anchor is being set.

Figure 2:
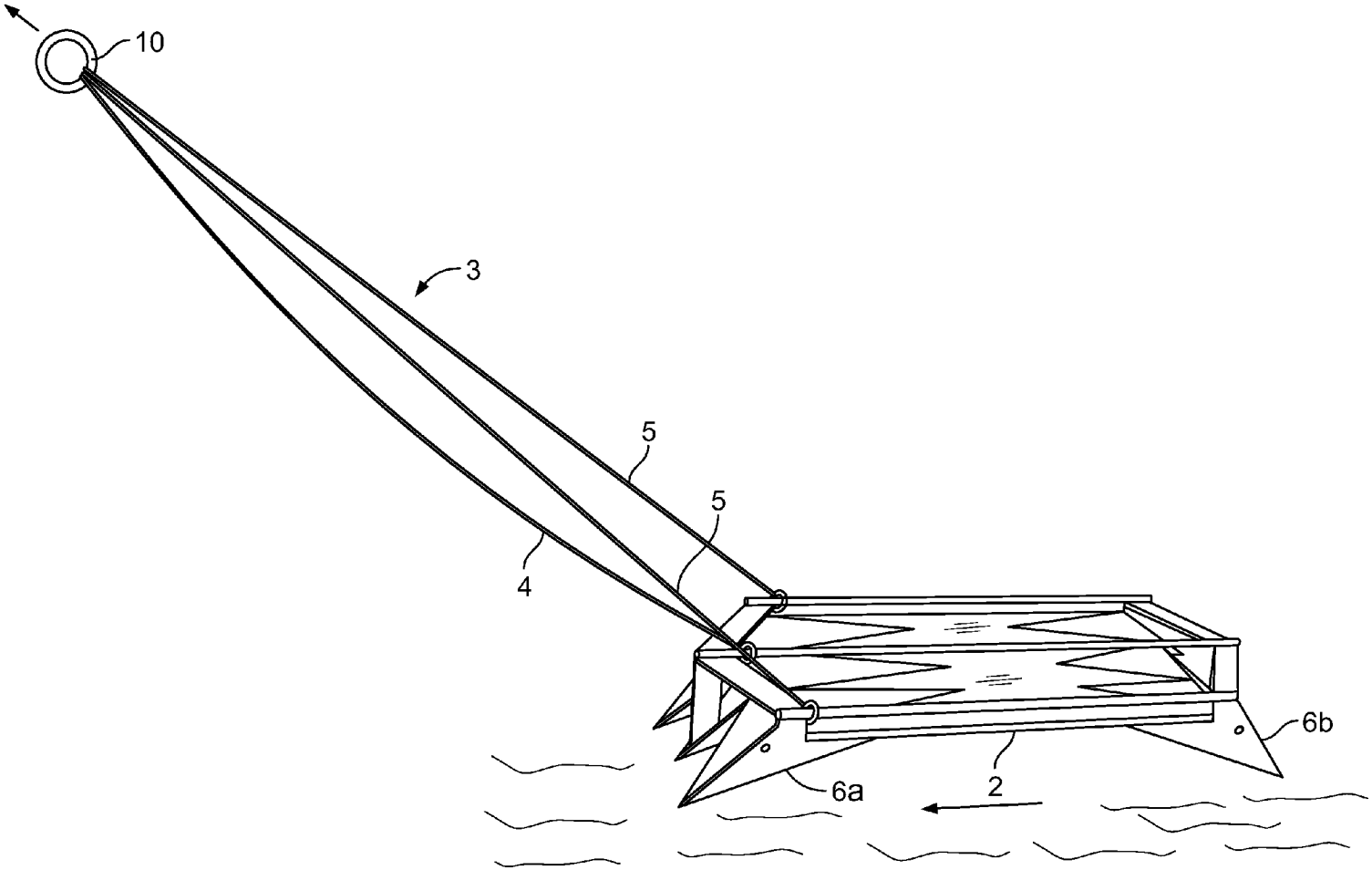
Figure 3:
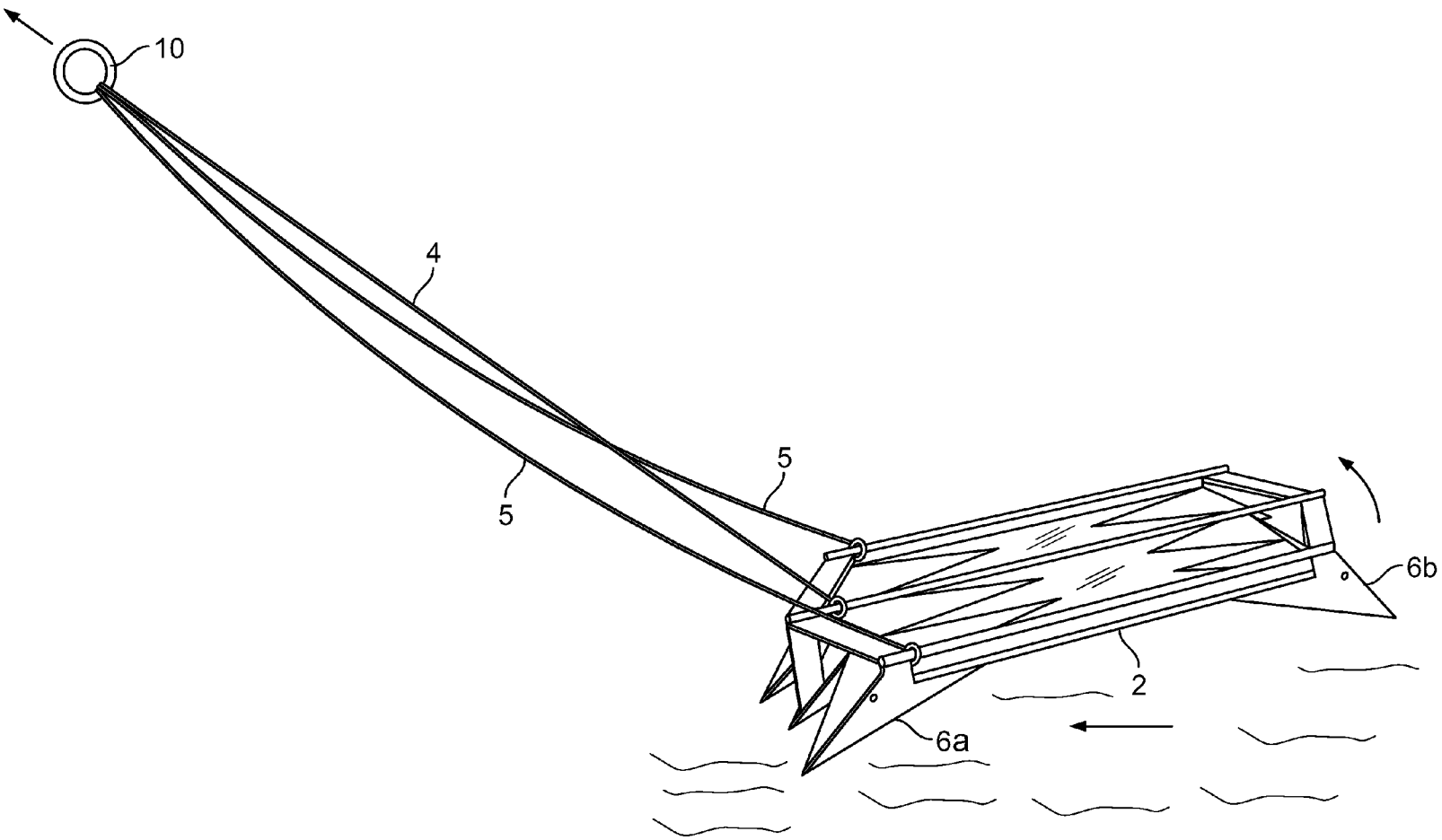
Figure 4:
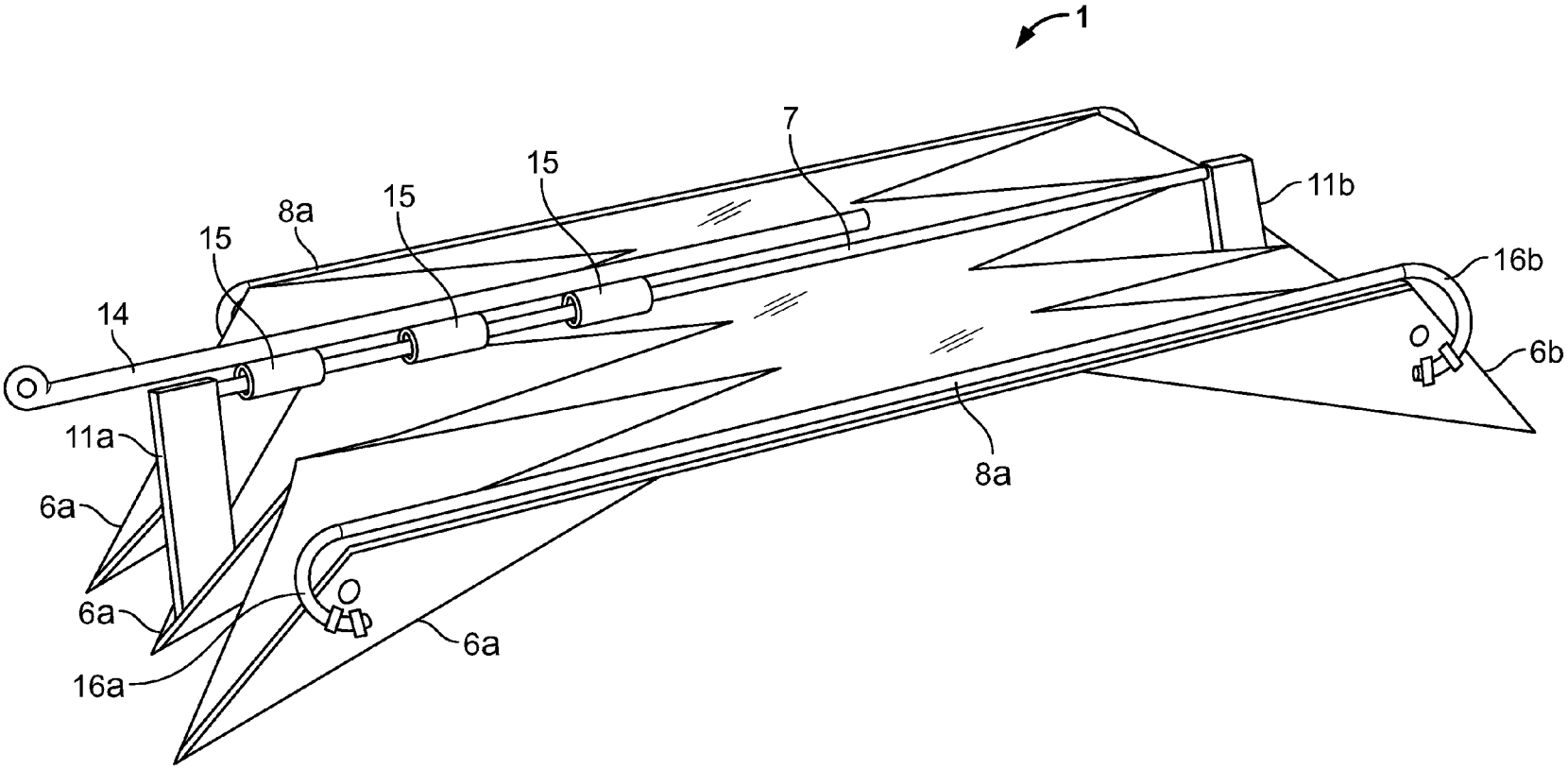

The invention will now be described, with reference to the accompanying drawings in which:

FIG. 1 is a perspective view of an anchor and a bridle assembly according to the invention, FIG. 2 is a perspective view of the anchor apparatus of FIG. 1 being dragged along the sea bed, FIG. 3 is a view corresponding to that of FIG. 2 but in which the anchor has become snagged on the sea bed at its leading end and has begun to tilt with its trailing end rising upwards, and FIG. 4 is a perspective view of a preferred embodiment of the invention.

Referring firstly to FIG. 1 anchor apparatus shown generally at 1 comprises a generally long, flat anchor 2 and associated 3-limb bridle 3 having a central bridle 4 and respectively opposite outer bridles 5. When deployed, the anchor body is designed to remain at an approximately horizontal attitude during and after setting, hanging vertically from the anchor line bridle only during dropping and recovery.

The body of the anchor 2 is fabricated from metal or other structural sheet and includes at each end one or more downwardly pointing fluted open spikes or claws 6*a* and 6*b* with which to dig into and funnel e.g. sand or mud from the sea bed (not shown).

The claws are permanently and rigidly attached to the horizontal back-plate of the anchor, and thus act as an integral structural element imparting a longitudinal flexural stiffness to the anchor body. At each end of the anchor 2, and fixed above the open end of each set of claws 6*a*, 6*b* is a plate ("V"-shaped in the example as illustrated) for additional lateral and torsional stiffness and affording suitable locations onto which are welded or otherwise secured the three parallel bridle rails; a central rail 7 and a pair of slightly shorter outer rails 8.

Other than the bridle and its sliding attachment described below, the anchor has no moving parts. Manufacture is based on simple fabrication techniques and involves no custom forgings or castings. Maintenance requirements are likewise minimal and simple.

The design is readily scalable according to required duty, and the basic anchor could also be incorporated into more complex configurations for specialist application. Conversely, several of the design's advantages could still be realised in a simplified, uni-directional variant, in applications requiring minimal size and weight.

The central bridle limb 4 and outer bridle limbs 5 are each connected to respective bridle rails 7, 8 via bridle rings 9 free to slide along the bridle rails 7, 8 so that the bridle 3 can re-orientate and move from the position shown at one end of the anchor 2 to the opposite end. The three bridle limbs 4, 5 are connected at their respective other ends to a single pulling ring 10 for pulling the anchor 2 in the manner as shown in FIGS. 2 and 3 via an anchor chain or cable (not shown).

The central bridle rail 7 is supported above the anchor 2 by leading and trailing bridle rail support plates 11*a*, 11*b* connected at their lower ends to the central ones of claws 6*a*, 6*b* and are supported centrally by cross-struts 12 which connect with the ends of the side rails 8.

In FIG. 2 the anchor 2 is shown resting on the sea bed with the bridle 3 being pulled via the pulling ring 10, itself connected to a cable or chain (not shown) of e.g. a boat or navigation buoy. In this condition the direction of travel of the anchor 2 along the sea bed is as shown arrowed in which the leading claws 6*a* are therefore able to dig into the sea bed as they are dragged along it, whereas the trailing claws 6*b* offer comparatively very little resistance to the drag over the sea bed. Upon reversal of the direction of the pull on the ring 10, such as could be caused by the ebb and flow of the tide it will be apparent that the ring 10 and hence bridle 3 will assume the opposite configuration whereby the formerly trailing claws 6*b* become leading claws. At each such reversal, because of the fluted shape of the claws 6*a*, 6*b*, which serve to act as scoops, it will be apparent that the anchor 2 becomes progressively embedded deeper in the sea bed, until an equilibrium is reached between the developing resistance of the bed material and the maximum load on the anchor line. The anchor 2, therefore, by this oscillatory motion buries itself into the sea bed at each change of direction of the tide, this being a particularly suitable feature where the anchor is used to secure vessels such as marker buoys.

The use of a bridle as opposed to a single-point attachment for the anchor line confers a further design advantage, in that the anchor 2 when being set is dragged along the sea bed primarily by the outer bridle limbs 5, which are physically separated at their respective attachment points to the outer bridle rails 8, close to the outboard extents of the anchor 2. This results in a more orderly passage as the anchor is dragged across the sea bed, minimising any yawing and transverse rolling due to unevenness and non-uniformity of the sea bed, and ensuring a good final alignment with the direction of pull.

The central bridle limb 4 and the central rail 7 to which it is attached, which extends slightly further at each end of the anchor 2 than the side rails 8. are not necessary to the basic setting operation of the anchor as described above, but serve to realise an important additional feature as can be seen with reference to FIGS. 2 and 3. In FIG. 2 it will be seen that the anchor 2 lays flat on the sea bed and is being pulled by the outer bridle limbs 5 with the central bridle limb 4 being slack. By contrast, in the position shown in FIG. 3 the anchor 2 has started to tilt—such as might result from encountering a hard spot in the sub-water substrate—with the trailing end beginning to lift (arrowed). This slight forward rotation of the anchor 2 results in the central bridle limb 4 becoming taut and the outer bridle limbs 5 correspondingly slack, thus lowering the point of action of the pulling line load on the anchor. This relatively sudden shift, acting in combination with the anchor's own weight, causes a temporary restoring moment about the anchor's leading end, bringing it back towards its desired near-horizontal attitude, until the corrected geometry re-tensions and transfers the pulling load back to the outer bridle limbs. In combination with the generally greater directional control effected by the bridle and as previously described, this self-correcting feature substantially reduces any propensity for the anchor to skip or overturn during setting. In comparison with a conventional anchor under similar sea bed conditions, the reliability of the setting operation is improved, and the drag distance required to achieve a secure set is substantially reduced.

Once set, the anchor offers several advantageous performance characteristics and operational features:

Holding capacity is very high in relation to the anchor's weight. Compared to a conventional anchor, a greater proportion of the device is ultimately "usefully" embedded, so maximising the shear and displacement resistance of the holding ground. Similarly, the efficiency of the claw design means less reliance on the weight of the anchor to achieve a secure initial embedment.

The reversibility of operation, as described above, affords secure holding under tidal or otherwise varying current and wind conditions.

The anchor, having no conventional shank, has a minimal above bed profile, thereby reducing hazard to other vessels operating in the vicinity in the case where navigable depths may be limited.

The anchor remains secure at comparatively steep mooring line angles—prototype trials have suggested safe working angles of the order of 45 degrees, nearly twice that at which conventional anchors may lift. This enables swinging circle radii to be substantially reduced. This does not however affect the ease of recovery by simple vertical haul, with no chaser system required.

In FIG. 4 there is shown a preferred embodiment of the invention which essentially differs from the embodiment shown with reference to FIGS. 1 to 3 by the removal of the cross-struts 12 in favour of an arrangement in which the central bridle rail 7 is supported above the main body of the anchor 2 solely by the leading support plate 11*a* and at its trailing end by a trailing support plate 11*b*, between each of which is slideably disposed on the central bridle rail 7 an elongate anchor shank 14 having three bridle rail capture sleeves 15 by which it is slideably secured on the central bridle rail 7, which itself is preferably made of high tensile steel. The use of a slideable anchor shank 14 instead of a single bridle ring 9 provides improved strength for the entire arrangement, it being understood that when the anchor 2 is being set the greatest load is borne by the central bridle rail 7 and its attachment to the central bridle limb 4.

In the preferred embodiment shown with reference to FIG. 4 it will also be seen that the side rails 8 are secured to but spaced from respectively opposite sides of respective leading and trailing claws 6*a*, 6*b* of the anchor 2, with each respective end 16*a*, 16*b*, being curved to provide a smooth transition for the bridle limb from the linear to the radial direction when anchor is pulled by the two outer bridle limbs 5.

The invention claimed is:

1. Anchor apparatus including an anchor and a slideable anchor bridle, the anchor having a lower part or body portion with oppositely disposed anchoring formations extending therefrom and an upper part including bridle attachment means in the form of at least two parallel bridle rails extending above and between the oppositely disposed anchoring formations, bridle limbs of the anchor bridle being slideably attached, in use, to respective bridle rails, the arrangement being such that when deployed, the anchor can be pulled in one direction whereby to permit one of the oppositely disposed anchoring formations to penetrate the sea bed and whereafter if and when the anchor is pulled in the opposite direction after the bridle limbs have slid along the bridle rails, the other of the oppositely disposed anchoring formations also penetrates the seabed, whereafter the anchor can continue to be pulled in successively alternate directions via the bridle to penetrate progressively further into the sea bed until firmly fixed therein.

2. Anchor apparatus according to claim 1 wherein the oppositely disposed anchoring formations are fluted claws or spikes.

3. Anchor apparatus according to claim 2 wherein at each end of the anchor, and fixed above an open end of each set of said claws, are cross-struts for additional lateral and torsional stiffness.

4. Anchor apparatus according to claim 3 wherein each respective pair of cross-struts at each end of the anchor is "V"-shaped.

5. Anchor apparatus according to claim 1 wherein the anchoring formations protrude from either end thereof.

6. Anchor apparatus according to claim 1 wherein the at least two parallel bridle rails comprises three parallel bridle rails including a central bridle rail and an outer rails and the bridle limbs comprise a central limb and an outer limbs, the central bridle rail being slightly longer than the outer rails such that, in the event of the anchor being pulled by the outer limbs of the bridle tipping forward the central limb of the bridle comes momentarily into tension, allowing the outer limbs to slacken and, because of its forward, protruded, position at an end of the central bridle rail so imparts to the anchor a restoring moment countering any forward tipping effect until the anchor resumes its proper attitude and its drag load is once more transferred to the outer bridle limbs.

7. Anchor apparatus according to claim 1 wherein the body portion of the anchor is fabricated from metal or other structural sheet.

8. An anchor adapted for use with a slideable anchor bridle, the anchor comprising or including a body portion with oppositely disposed anchoring formations extending therefrom and bridle attachment means in the form of at least two parallel bridle rails extending above and between the oppositely disposed anchoring formations, the bridle rails being connectable to respective bridle limbs of an anchor bridle such that, in the use, when the anchor is deployed it can be pulled in one direction whereby to permit one of the oppositely disposed anchoring formations to penetrate the sea bed and whereafter if and when the anchor is pulled in the opposite direction after the bridle limbs have slid along the bridle rails, the other of the oppositely disposed anchoring formations also penetrate the sea bed, whereafter the anchor can continue to be pulled in successively alternate directions via the bridle to penetrate progressively further into the sea bed until firmly fixed therein.

9. An anchor according to claim 8 comprising or including a central bridle rail and two oppositely disposed side rails.

10. An anchor according to claim 9 wherein the side rails have curved ends.

11. An anchor according to claim 10 wherein the curved ends are fixed to the oppositely disposed anchor formations.

12. An anchor according to claim 8 wherein the anchor formations are in the form of fluted claws or spikes.

* * * * *